US005207440A

United States Patent [19]

Liang

[11] Patent Number: 5,207,440

[45] Date of Patent: May 4, 1993

[54] ARTICLE OF WHEELED, STEERABLE LUGGAGE

[76] Inventor: Joseph Liang, P.O. Box 1060, Alpine, N.J. 07620

[21] Appl. No.: 956,603

[22] Filed: Oct. 5, 1992

[51] Int. Cl.[5] ..... B62B 3/02

[52] U.S. Cl. ..... 280/47.11; 280/37

[58] Field of Search ..... 280/47.11, 37, 38, 87.021, 280/47.131, 87.041, 47.17, 87.05, 47.24, 47.26, 47.34, 30, 47.371, 92; 180/208, 907

[56] References Cited

U.S. PATENT DOCUMENTS

| | | | |
|---|---|---|---|
| Re. 29,036 | 11/1976 | Hager | 280/37 |
| 4,913,252 | 4/1990 | Bartley et al. | 180/208 |
| 5,048,649 | 9/1991 | Carpenter et al. | 380/37 |
| 5,108,119 | 4/1992 | Huang | 280/37 |

FOREIGN PATENT DOCUMENTS

| | | | |
|---|---|---|---|
| 2528992 | 1/1976 | Fed. Rep. of Germany | 280/47.11 |
| 2607089 | 5/1988 | France | 280/87.041 |

*Primary Examiner*—Richard M. Camby

*Attorney, Agent, or Firm*—Cohen, Pontani, Lieberman, Pavane

[57] ABSTRACT

An article of wheeled luggage having a pair of rear wheels for rolling engagement with an underlying support surface further includes a control rod located in close proximity to the front wall of the luggage and carrying a freely-rotatable front wheel at its bottom end and a pivotally-attached pull-handle at its top end. The control rod extends substantially vertically along at least a portion of the front wall and is axially rotatable so as correspondingly vary the orientation of the front wheel which is maintained in rolling engagement with the support surface. The control rod has a generally L-shaped construction including an upper leg extending along the front wall and a lower leg disposed proximate the bottom wall of the article of luggage, the front wheel being mounted in a predeterminately-fixed orientation on the lower leg. User-controlled variations in the intended direction of movement of the article along the support surface are transferred from the user-grasped pull-handle, through the control rod and to the front wheel to provide effective and substantially effortless steering of the article as the same is moved on and along the support surface.

11 Claims, 3 Drawing Sheets

FIG. 1
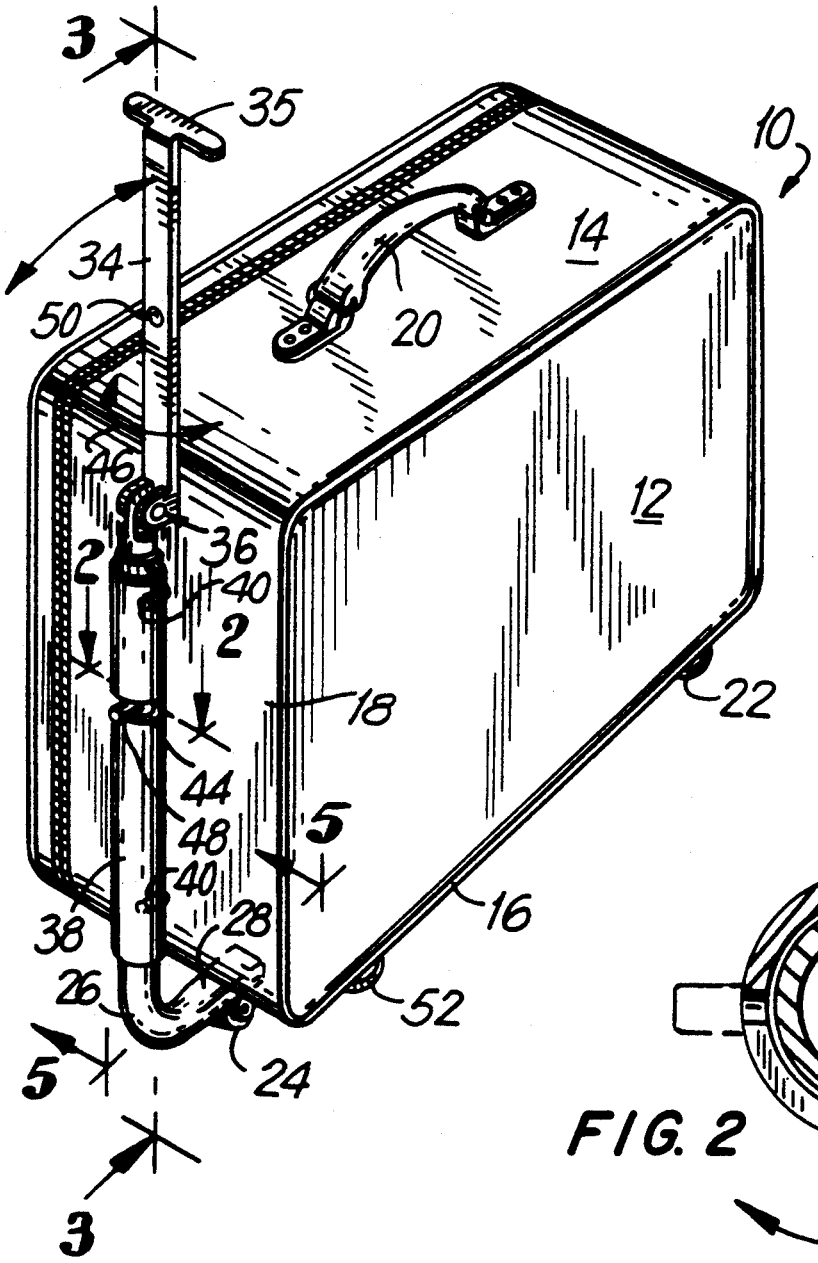
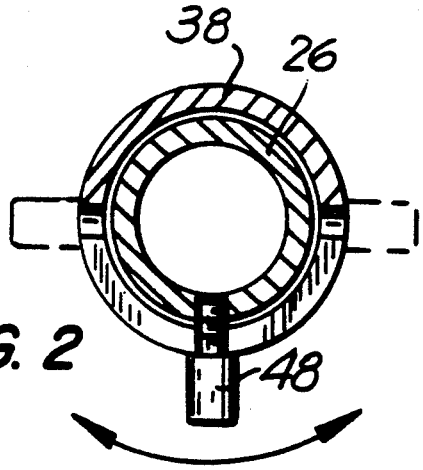
FIG. 2

ARTICLE OF WHEELED, STEERABLE LUGGAGE

FIELD OF INVENTION

The present invention relates generally to wheeled luggage and, more particularly, to an article of wheeled luggage having an integrated handle and front wheel assembly that facilitates changes in the direction of forward movement of the article of luggage as the same is pulled by the user along an underlying support surface.

BACKGROUND OF THE INVENTION

The typical time pressures encountered by a traveler meeting airplane or train schedules are often complicated by large, cumbersome and/or heavy suitcases or like articles of luggage. In order to avoid the direct lifting or carrying of such luggage, individual articles of luggage are characteristically rendered movable along an underlying ground or support surface by the provision of a number of wheels or castors attached to the bottom surface or wall of the luggage for rotation in the forward direction of travel. In some cases, such wheels are implemented as castors which are capable of pivoting about an axis defined substantially perpendicular to the bottom wall, thereby facilitating changes or variations in the intended direction of forward movement of the luggage along the support surface. Each piece of movable luggage also typically possesses a strap or other handle connected to or proximate the top wall or surface or along a side or front face thereof for permitting the user to pull the luggage along the ground surface and/or carry the luggage from place-to-place.

The pull-forces necessary for causing such wheeled luggage to move from a rest position to a moving state along the ground surface, or for changing the direction of motion while the luggage is in the moving state, are thus generally directed to a point located at or above, and most typically substantially higher than, the center of gravity of the luggage. As a consequence, the required pull-forces to move such articles of luggage can easily result in unintended tipping or misdirection of the article on or along the underlying support surface. Turning or redirection of the luggage from a stopped position or while the article is in motion further requires that the user overcome the then-current inertial forces by pulling, pushing or twisting the handle or strap so as to translate and distribute the turning forces through the luggage to the pivotal axes of the wheels or castors. It is only in this manner that the wheels are turned via such translated forces to change the direction of travel. It can therefore be appreciated that greater forces are required to turn such an article of wheeled luggage than to simply move the article forwardly along a straight line, since a rather sizeable component of the forces exerted must first turn the entire mass of the article to rotate the attached wheels, leaving only the remaining force component for actually advancing the article in its intended new direction. Moreover, the handle or strap attached to the luggage, through which these forces are applied and distributed, is severely stressed by such ations, and a potentia point of component failure is established at the attachment of the handle. Additionally, changing the direction of motion of the luggage is frequently a slow, difficult and imprecise process as a consequence of the need to pull, push or twist the handle in order to successfully translate these forces from a twisting action of the mass or weight of the luggage to a pivoting action of the wheels or castors about their pivotal axes. Such known devices are therefore intrinsically restricted in their freedom of motion by virtue of their design and are relatively ineffective and inefficient in energy-input requirements and in their capacity to suitably distribute the forces for motion. Although there have been numerous attempts to provide an assembly which overcomes the above-mentioned drawbacks, the proposed devices or arrangements are typically unacceptably expensive or complex to manufacture and often add undue extra weight to the article of luggage.

Castors for container supports, in contrast to those provided for moving luggage along a flat surface, have long been known in the art. For example, in U.S. Pat. No. 1,975,291 to Ritter, Jr., a series of castors provides rotary support of a trunk having oppositely-disposed luggage compartments to enable manipulation of the closure of the trunk without requiring a shift or change in position by the operator. However, the Ritter castors are neither utilized nor suggested for use in moving the luggage along a flat surface.

As shown in U.S. Pat. No. 2,605,989 to Luft, roller assemblies have been used as a turntable base for moving luggage along a flat surface or floor and for providing pivoting of the piece of luggage upon the assembly to which it is attached. However, for the same reasons noted above, Luft's rolling assemblies are restricted in their freedom of motion and are inadequate in their distribution of the forces for moving the luggage and changing its direction of motion.

The use of castor mountings for luggage is also known in the art. For example, in U.S. Pat. No. 3,526,921 to Aupke, castors are provided along a bottom face of a suitcase and are removably mounted through socket apertures drilled or punched in the bottom face. Aupke's castors possess the drawbacks described above, i.e. pivoting is imprecise and difficult, and the forces required for moving the suitcase are input at a location that lies a substantial distance above the center of gravity, rather than directly to a pivoting point. Consequently, freedom of motion of Aupke's luggage is restricted, and the forces must be distributed through the handle which, in Aupke's device, is the same top-wall handle that is used for carrying the luggage.

A luggage handle doubling for both carrying and moving, along an underlying surface, a piece of wheeled luggage is also disclosed in U.S. Pat. No. 4,838,396 to Krenzel. The Krenzel luggage handle enables the user to maintain a relatively upright position while dragging the case along a ground surface. The rear face of the Krenzel luggage carries a single front castor wheel and non-pivoting rear wheels, i.e., wheels which do not pivot about an axis defined substantially perpendicular to the rear face of the luggage. Such wheeled luggage possesses the same drawbacks pointed out above and, in addition, the single front wheel of this particular arrangement provides seriously diminished stability in maintaining the luggage in an upright condition as it is moved along an underlying support surface.

A removable luggage carrier is also described in U.S. Pat. No. 3,861,703 to Gould in which each of four separate castor wheels is mounted on a plate that is attached by releaseable fasteners to a side or rear face of and proximate a respective corner of an article of luggage. The luggage handle normally used for carrying the article equipped with the Gould device is also employed for moving the luggage along a flat surface upon the detachable castor assemblies. Thus, Gould neither addresses nor overcomes the problems discussed above.

The present inventor's co-pending U.S. patent application 07/725,339 describes a moveable article of luggage having a pair of freely-rotatable front wheels mounted to a retaining and pivoting assembly which maintains the front wheels at a fixed distance apart, and a pull-type handle device. The retaining and pivoting assembly provides for unitary and concurrent pivoting of the front wheels about a forward axis and is pivotally secured to the bottom wall of the luggage article at the forward axis. The handle device is, in turn, attached to the retaining and pivoting assembly for distributing and translating the forces required for moving the luggage along an underlying support surface and for changing the direction of rolling travel of the luggage by accurately pivoting the retaining and pivoting assembly in a direct and unitary manner. Such an arrangement, although successfully overcoming the most significant of the deficiencies of the prior art, is of relatively complex construction and may, depending upon the materials used in fabrication and construction, undesirably add unnecessary weight to the resulting article of luggage.

OBJECTS OF THE INVENTION

Accordingly, it is an object of the present invention to provide an integrated pull-handle and supporting wheel assembly for an article of luggage that of less complex construction and less expensive to manufacture than has heretofore been known.

It is a further object of the invention to provide a such an assembly that does not add substantial weight to the article of luggage.

It is another object of the present invention to provide an article of luggage having a wheel assembly that allows for substantially greater multidirectional mobility and user-controllable pivoting motion of the luggage on and along an underlying support surface.

It is a still further object of the instant invention to provide a wheeled article of luggage having a coaxially-supported supporting member retaining a substantially L-shaped tubular member having an orientationally-fixed wheel carried thereon.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

SUMMARY OF THE INVENTION

In a currently embodiment of the present invention, an article of wheeled luggage selectively moveable on and along an underlying support surface in a user-controllable direction of movement is provided with a plurality of walls bounding an interior, closeable compartment for containing articles within the compartment, the plurality of walls including a bottom wall and a front wall. A pair of freely-rotatable rear wheels are mounted to and project from the bottom wall for rolling engagement with the support surface. A tubular member is provided having a vertical portion disposed proximate the front wall and a horizontal portion depending from one end of the vertical portion and disposed proximate the bottom wall. A freely-rotatable front wheel is carried on the horizontal portion for rolling engagement with the support surface and at a fixed orientation relative to the horizontal portion. A supporting member is mounted in fixed relation to the front wall and captively supporting the tubular member for axial rotation of the vertical portion relative to the supporting member and front wall so that axial rotation of the vertical portion carried the horizontal portion through a corresponding pivotal motion and the front wheel through a corresponding angular reorientation. Finally, a pull-handle is pivotally attached to the tubular member at a second, opposite end of the vertical portion and is graspable by a user for transferring user-applied, selectively-directed pull forces to the article of luggage for moving the article along the support surface and for selectively changing the direction of movement of the article of luggage along the support surface by pull-handle means-imparted rotational movement of the tubular member to angularly reorient the front wheel for movement of the article of luggage in a newly selected direction.

DETAILED DESCRIPTION OF THE DRAWINGS

In the drawings, wherein like reference characters denote similar elements throughout the several views:

FIG. 1 is an elevated front perspective view of an article of wheeled luggage constructed in accordance with the teachings of the present invention;

FIG. 2 is a cross-sectional view taken along the lines 2—2 of FIG. 1;

DETAILED DESCRIPTION OF THE PREFERRED EMBODIMENTS

Figure 3:
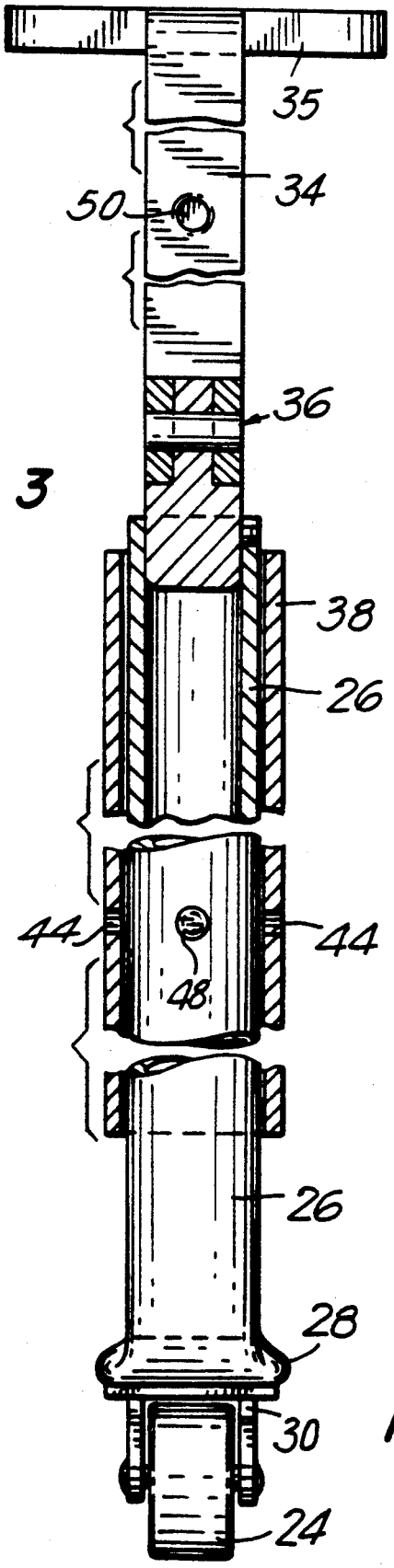
FIG. 3 is a partial cross-sectional view taken along the lines 3—3 in FIG. 1, with the pull-handle member seen in its operative position.
Figure 4:
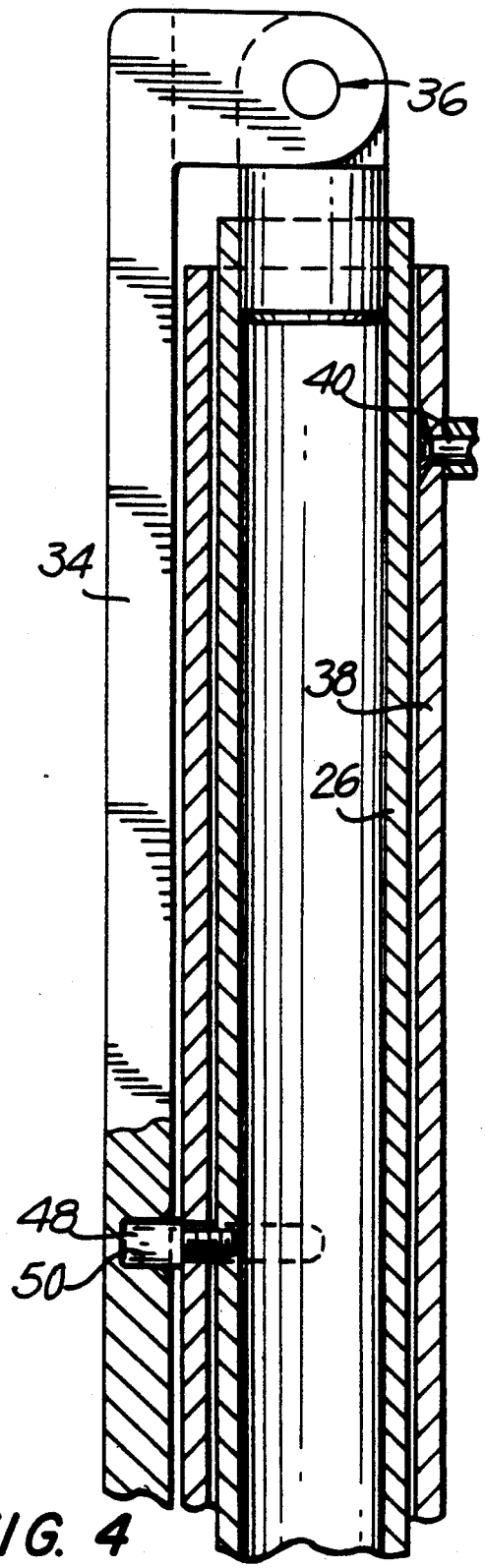
FIG. 4 is a partial cross-sectional view showing the pull-handle member in its storage position.

The present invention is directed to an article of wheeled luggage that incorporates a steering and pull-forces distribution arrangement that notably enhances ease of use and facilitates user-controlled variations in the direction of forward movement or travel of the article of luggage along an underlying ground or support surface. In its broadest sense, the invention provides a steerable front wheel on such an article of luggage, the steerable wheel being mounted to an elongated control rod to which a user-graspable pull-handle is also attached. The control rod is supported on or in close proximity to, and extends along at least a portion of, the front wall of the luggage and there maintained for rotation about an axis in response to user-imparted changes in the direction in which the luggage is pulled. Such rotations of the control rod, which may be limited through a predetermined range, directly carry the front wheel mounted thereon through corresponding changes in its direction of angular orientation relative to the bottom wall of the article of luggage so as to thereby steer or control the direction of forward travel of the luggage in direct response to the user-imparted pull-forces transferred to the control rod through the pull-handle.

The invention is described, by way of currently preferred example, with respect to the article of luggage 10 depicted in FIGS. 1 to 6. To facilitate such description, the orientation of the article 10 shown in FIG. 1—i.e. upstanding on an underlying support surface in condition for being selectively pulled and controlledly directed along the surface by a user—is assumed.

Turning now to FIG. 1 of the drawings, the article of luggage 10 is formed of a plurality of walls bounding, as is known in the art, an interior, closeable compartment for containing articles therewithin. More particularly, the article 10 includes a pair of opposed side walls 12 (only one of which is seen in FIG. 1), a top wall 14, a bottom wall 16, a front wall 18 (the term "front" denoting the normal direction of forward travel of the article along a support surface as the article is pulled or otherwise moved by a user), and a rear or back wall (not shown). The top wall 14 may have a conventional strap-type or other handle 20 mounted thereto, as is common in the art.

A pair of freely-rotatable rear wheels 22, only one of which is visible in FIG. 1, are carried on the bottom wall 16 of the article 10 for rolling engagement with the underlying support surface. It is generally contemplated that the wheels 22 be located along or closely proximate the transverse edges of the bottom wall 16 and remote from the front wall 18 or, in other words, closer to the rear wall of the article 10 than to the front wall 18. The wheels 22 are preferably non-castor type wheels, which is to say that they are mounted to the bottom wall 16 in a fixed orientation and, more particularly, so that each wheel is substantially aligned with the front-to-back elongation of the bottom wall 16. This arrangement is common in the art of steerable luggage, in which it is known to use castor-type wheels or otherwise provide steerability or variability in the direction of rotation of the luggage-supporting wheels only to front wheels while the rear wheels remain orientationally fixed.

Figure 5:
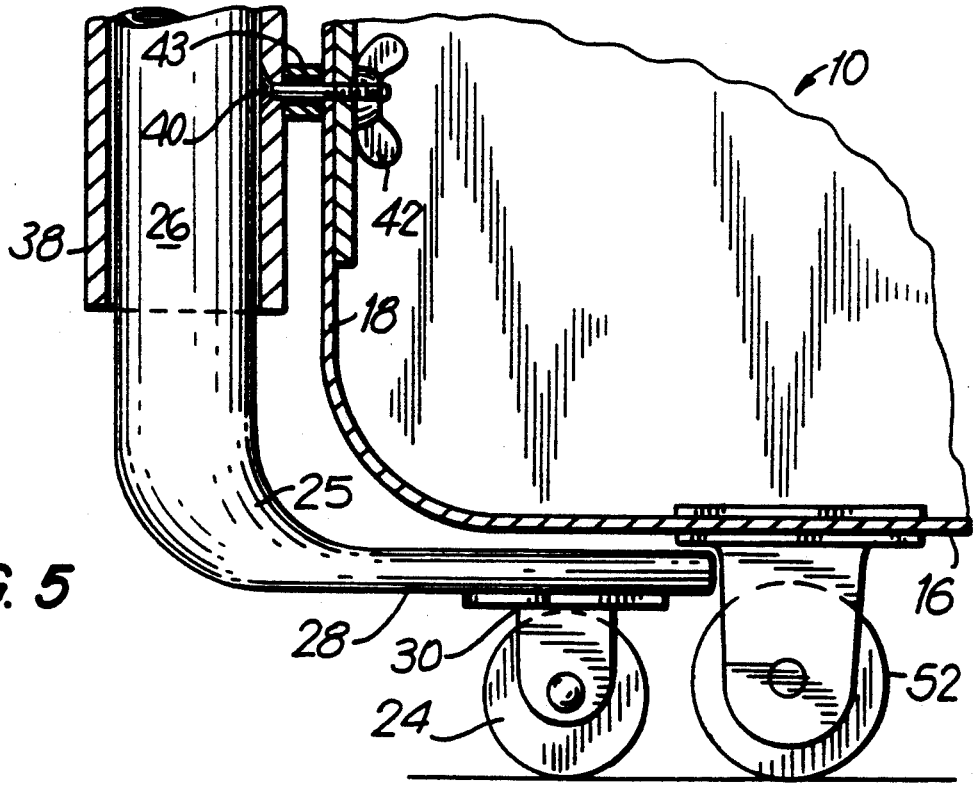
FIG. 5 is a partial cross-sectional view taken along the lines 5—5 in FIG. 1.
Figure 6:
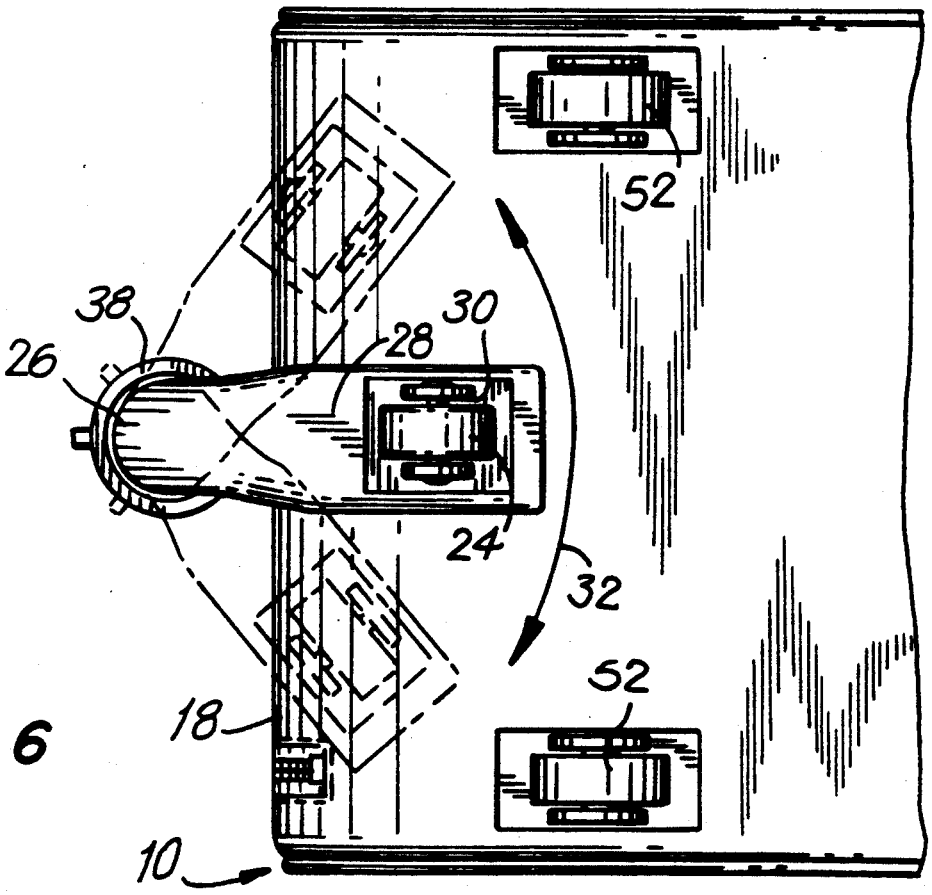
FIG. 6 is a partial bottom plan view of the forward portion of the article of wheeled luggage of FIG. 1.

A front wheel 24 is mounted, as perhaps best seen in FIG. 5, on a control rod that is, in turn, retained at the forward end of the article of luggage 10. In the specific arrangement herein shown and described, the control rod is implemented as an elongated, generally tubular member that at its lower end carries the front wheel 24 for rolling engagement with the underlying support surface and at its upper end is pivotally connected to a user-graspable pull-handle, as is hereinafter described. The front wheel is freely rotatable about an axis defined substantially parallel to the plane of the bottom wall 16 but is orientationally fixed relative to the control rod to which it is mounted, much as the freely-rotatable rear wheels 22 are orientationally fixed with respect to the bottom 2 wall 16 to which they are mounted.

The control rod of the herein-depicted article 10 is a generally L-shaped member having a substantially 90-degree bend 25 that separates and defines, on opposite sides of the bend 25, an elongated upper or substantially vertically-oriented leg or portion 26 and a lower or substantially horizontally-oriented leg or portion 28. The upper leg 26 has a generally round or otherwise tubular cross-section and extends vertically along at least a portion of the lengthwise extension of the front wall 18. In the illustrated article of luggage 10, the upper leg 26 is maintained in closely adjacent proximity to the outer face of the front wall 18, although embodiments of the invention in which the upper leg 26 is instead supported on or closely adjacent the interior face of the front wall 18, or within the interior of the front wall 18, are also contemplated.

In contrast to the upper leg 26, the substantially horizontal lower leg 28 is of relatively flattened cross-section and lies substantially parallel to and, preferably, in relatively closely spaced proximity to, the bottom wall 16 or the article 10. The front wheel is mounted to the lower leg 28 at a predeterminately-fixed orientation of rotation, as for example by the bracket 30, such that angular changes in the orientation of the lower leg 28—as depicted by the double-headed arrow 32 in FIG. 6—result in corresponding redirection of the rotative orientation of the front wheel 24. The flattened configuration of the lower leg 28, while not required, advantageously facilitates mounting of the front wheel 24 to the lower leg.

At its upper end, i.e. that end opposite its unitary connection (through the bend 25) to the lower leg 28, the upper leg 26 of the control rod carries a pull-handle is formed as a generally T-shaped member having an elongated shaft that is pivotally connected at one end to the upper leg 26 by a hinge 36 and at its opposite end defines a user-graspable portion 35 of any suitable form or design. The pull-handle 34, as will hereinafter be apparent, is pivotably moveable relative to the upper leg 26 between a storage position of nonuse, seen in FIG. 4, and a position of normal use that will vary as a function of the physical characteristics and wishes of the user but a relatively extreme position of which is shown in FIGS. 1 and 3.

The arrangement for mounting of the control rod proximate the front wall 18 of the illustrated article 10 will now be described. It should, however, be pointed out that the particular mounting arrangement herein shown and described is intended to be taken as only one example of a construction for accomplishing the intended functionality, and numerous alternate arrangements and constructions are both intended and contemplated as within the scope of the present invention. Thus, and with particular reference to FIGS. 1, 3 and 5, an elongated sleeve 38 is secured to the front wall 18, as for example by countersunk screws 40 and mating wingnuts 42 or the like, such that the sleeve extends substantially vertically along at least a portion of and, preferably, substantially parallel to, the wall 18. In FIG. 5, for example, the sleeve is seen as being spaced from the front wall 18 by tubular spacers 43. Although the sleeve 38 is depicted in the drawings as being closely spaced from the front wall 18, alternate arrangements in which the sleeve 38 directly abuts the outer face of the wall 18, or is disposed in closely spaced or abutting relation with the interior face of the wall 18 (i.e. within the interior, closeable compartment of the article 10), or is fully contained (and thereby hidden from view) within the wall 18, or is otherwise concealed within a housing or covering associated with the wall 18 or an additional layer of the wall 18, are also within the intended scope and contemplation of the invention; such variations are to be considered general matters of design choice. A portion of the upper leg 26 of the control rod is journalled through the sleeve 38 and is retained within the sleeve, as is hereinafter described, for axial rotation of the upper leg relative to the sleeve. Toward that end, the internal diameter of the sleeve 38 is preferably sized just slightly larger than the outer diameter of the tubular upper leg 26, thereby permitting the intended rotatability of the leg 26 while minimizing or effectively preventing wobble or other nonaxial motions of the leg 26 as the same is axially rotated relative to the fixedly-mounted sleeve.

In order to prevent unintended axial displacement of the upper leg 26 relative to the coaxially-disposed sleeve 38, an elongated slot 44 is defined in the sleeve at any suitable location intermediate its ends. In the illustrated embodiment, the slot is located somewhat centrally along the sleeve and extends substantially perpendicular to the sleeve elongation. The slot may, instead, be oriented at another angle to the sleeve elongation or, indeed, may be shaped and oriented in any selected manner for implementing a particular functionality. For example, the sleeve slot may have the form of a somewhat flattened letter "V" so that, as the pull-handle 34 is pivoted (as indicated by the double-headed arrow 46 in FIG. 1) from its "straight-ahead" position, the upper leg 26, and thereby the pull-handle 34, rises in a predetermined limited manner in accordance with the upwardly-pitched arms of the "V"-shaped slot. This optional functionality will become apparent as this description proceeds.

The upper leg 26 of the control rod carries a pin 48, implemented in the illustrated embodiment as a post having a continuous thread running along a portion of the post, which pin projects outwardly from the leg 26 and extends through the sleeve slot 44. The pin 48, through its cooperative interengagement with the slot 44, accordingly serves to prevent unintended axial displacement of the upper leg 26 along and relative to the sleeve 38 as the pin follows or moves along the edges-defined contours of the slot. At the same time, the slot—or more particularly the extent of its elongation—effectively limits the range of rotatability of the upper leg 26 relative to the sleeve 38 since the opposite ends of the slot function as stops or limit edges against which the pin 48 abuts as the rotated upper leg 26 carries the pin to its permissible limits of rotative displacement within and along the slot.

In a particularly preferred form of the inventive article 10, a cavity 50 is defined in the elongated shaft of the pull-handle 34. The cavity 50 is sized and located along the shaft such at, when the pull-handle is disposed in its storage (i.e. FIG. 4) position, the pin 48 projects into the cavity 50. In a most-preferred form, the cavity 50 and/or the pin 48 is further sized, and/or the pin 48 is formed or covered with a resilient material, and/or the cavity contains an insert (not shown) or resilient or otherwise suitable material, such that the pin 48 attains a frictional fit or engagement with the wall or insert of the cavity 50 so as to thereby effectively retain the FIG. 4 storage position of the pull-handle even when the article 10 is tipped or laid on an end or side wall or is otherwise reoriented from its FIG. 1 condition.

The operation and use of the inventive article of luggage 10 should now be apparent. During periods of nonuse—i.e. when the luggage is supported by its wheels on an underlying ground or other support surface but is not being pulled along the support surface by its pull-handle 34, the pull-handle is normally disposed in the storage position seen in FIG. 4. In that position, the elongated shaft of the pull-handle lies along and in substantial abutment, or at least close proximity or adjacency, to the sleeve 38 and therein-journalled upper leg 26 of the control rod. The preferred receipt of the outwardly-projecting pin or post 48 in the pull-handle cavity 50 in the FIG. 4 position protects the integrity of the hinge 36 by preventing transverse or side-to-side motion of the pull-handle shaft away from the sleeve 38.

When it is desired to guidedly pull the article 10 along the support surface, the user lifts the pull-handle 34 so as to pivot the same about the hinge 36 whereby the pull-handle is raised to a user-determined extent. Typically, and depending (for example) on the height of the user relative to the size of the article 10, the pull-handle 34 will thereby be positioned so as to project outwardly and, generally, at least somewhat forwardly from the front wall 18. FIGS. 1 and 3 depict relatively extreme positions of the pull-handle in which the pull-handle has been pivoted to an orientation virtually straight up from and substantially in line with the elongation of the upper leg 26; the amount of pivotal motion applied by the user will, in general, be somewhat less than that shown. In any event, grasping the pull-handle 34 by the portion 35, the user may then selectively pull and thereby move the article 10 along the support surface as the wheels 22, 24 roll along that surface.

As the user changes or varies his direction of forward motion, pulling the article 10 along by the pull-handle 34, these changes of direction are transferred to the upper leg 26 of the control rod by the pull-handle. Thus, as the pull-handle is moved from its "straight-ahead" or on-axis position, as indicated by the arrow 46 in FIG. 1, the upper leg 26 is correspondingly axially rotated within the sleeve 38 through the hinge 36. This axial rotation of the upper leg is likewise transferred through the bend 25 to the lower leg 28, as indicated by the arrow 32 in FIG. 6, and the front wheel 24 that is mounted on the lower leg in a fixed orientation is correspondingly carried through the same orientational variation. In this manner, the user's changes in the direction of forward motion are directly imparted, through the pull-handle 34 and upper and lower legs 26, 28, to the front wheel 24 which is thereby functions to steer or redirect or reorient the direction of travel of the article 10 to conform to that of the user. Such changes of direction in the movement of the article of luggage along the underlying support surface are, in accordance with the present invention, accomplished virtually without additional effort and, indeed, are substantially transparent to the user. Moreover, the location of the connection of the pull-handle 34 to the control rod and, thereby, to the main body of the article 10—i.e. at or closely proximate the top of the front of the body and, more particularly, closely proximate the top of the front wall 18—further maximizes the transfer of user-imparted forces from the pull-handle to the luggage body and thereby minimizes that effort required to move and redirect or reorient the article 10.

In implementing the present invention, numerous variations and changes in the specific embodiment of an article of luggage herein illustrated and described may be provided without varying from the intended scope of the invention. For example, to provide increased stability of the article 10 the same may optionally, and additionally, be provided with a pair of freely-rotatable auxiliary front wheels 52. The auxiliary wheels 52 may be mounted in a fixed orientation to the bottom wall 16 or, as is preferred, they may be implemented as castor-type wheels so that they orientations will vary with user-controlled variations in the orientation of the directly-steerable front wheel 24. Similarly, although the control rod is herein disclosed as having a generally L-shaped construction, the control rod may alternatively have a different shape so long as it otherwise provides the functionality afforded by and in accordance with the teachings of the present invention.

It should accordingly be understood that the preferred embodiments and specific examples of modifications described are for illustrative purposes only and are not intended to be construed as limitations on the scope of the present invention. Thus, while there have been shown and described and pointed out fundamental novel features of the invention as applied to preferred embodiments thereof, it will be understood that various omissions and substitutions and changes in the form and details of the illustrated and disclosed apparatus may be made by those skilled in the art without departing from the spirit of the invention. It is the intention, therefore, to be limited only as indicated by the scope of the claims appended hereto.

What is claimed is:

1. An article of wheeled luggage selectively movable on and along an underlying support surface in a user-controllable direction of movement, comprising:

a plurality of walls bounding an interior, closeable compartment for containing articles within said compartment, said plurality of walls including a substantially horizontal bottom wall and a substantially vertical front wall;

a pair of freely rotatable rear wheels mounted to and projecting from said bottom wall for rolling engagement with the support surface;

a tubular member having an elongated substantially vertical portion disposed proximate said front wall and a substantially horizontal portion depending from one end of said substantially vertical portion and disposed proximate said bottom wall;

a freely rotatable front wheel carried on said substantially horizontal portion for rolling engagement with the support surface and having a fixed orientation relative to said substantially horizontal portion;

a supporting member mounted in fixed relation to said front wall and captively supporting said tubular member for axial rotation of said substantially vertical portion relative to said supporting member and said front wall so that axial rotation of said substantially vertical portion carries said substantially horizontal portion through a corresponding pivotal motion and said front wheel through a corresponding angular reorientation; and pull handle means pivotally attached to said tubular member at a second end of said substantially vertical portion opposite said one end and graspable by a user for transferring user-applied, selectively-directed pull forces to the article of luggage for moving the article along the support surface and for selectively changing the direction of movement of the article of luggage along the support surface by pull-handle means-imparted rotational movement of said tubular member to angularly reorient said front wheel for movement of the article of luggage in a newly selected direction.

2. An article of wheeled luggage according to claim 1, wherein said bottom wall has a width and said front wheel is carried by said substantially horizontal portion at least closely proximate a substantial midpoint of said bottom wall width.

3. An article of wheeled luggage according to claim 1, wherein said substantially vertical portion comprises an elongated tube and said supporting member comprises a sleeve within which at least a portion of said tube is journalled for axial rotation of said tube relative to said sleeve.

4. An article of wheeled luggage according to claim 3, wherein said sleeve is secured to at least one of said plural walls so that at least a portion of said tube extends along said front wall.

5. An article of wheeled luggage according to claim 1, wherein said tubular member comprises an elongated tube including a substantially right-angle bend separating and defining said substantially vertical and substantially horizontal portions of said tubular member on opposite sides of said bend.

6. An article of wheeled luggage according to claim 5, wherein said supporting member comprises a sleeve within which at least a portion of said substantially vertical portion is journalled for axial rotation of said substantially vertical portion relative to said sleeve.

7. An article of wheeled luggage according to claim 6, further comprising a slot defined in said sleeve and a pin projecting outwardly from said tube and through said slot at a location along said substantially vertical portion journalled within said sleeve for maintaining said substantially vertical portion in captive relation within said sleeve and limiting said axial rotation of the substantially vertical portion within and relative to the sleeve.

8. An article of wheeled luggage according to claim 5, wherein said pull handle means comprises a cavity predeterminately located so that, when said pull handle means is disposed in a storage position of nonuse, said cavity receives therein said pin.

9. An article of wheeled luggage according to claim 1, wherein said pull handle means comprises an elongated shaft pivotally connected at a first shaft end to said substantially vertical portion second end and carrying a pull handle at a second shaft end opposite said first shaft end, said shaft being pivotally movable between a first storage position in which said shaft is disposed substantially parallel to said substantially vertical portion during periods of nonuse and a second use position in which said shaft extends outwardly from said front wall of the article of luggage such that the user may grasp the pull handle and selectively apply pull-forces to the article of luggage for moving the article of luggage along the support surface.

10. An article of wheeled luggage selectively moveable on and along an underlying support surface in a user-controllable direction of movement, comprising:

a plurality of walls bounding an interior, closeable compartment for containing articles within said compartment, said plurality of walls including a bottom wall and a front wall;

a pair of freely rotatable rear wheels mounted to and projecting from said bottom wall remote from said front wall for rolling engagement with the support surface;

user-controllable means for controlling a forward direction of movement of the article of luggage along the underlying support surface, said means comprising an elongated member disposed closely proximate said front wall and extending along at least a portion of said front wall between a first end proximate said bottom wall and a second end opposite said first end, a freely rotatable front wheel carried at a predeterminately-fixed orientation of rotation on said elongated member proximate said first end for rolling engagement with the underlying support surface, and an elongated pull handle pivotally secured at a first pull handle end to said elongated member proximate said second end and configured at a second pull handle end for grasped engagement with a user's hand; and mounting means for retaining said user-controllable means in closely proximate relation to said front wall and for axially rotative movement of said elongated member relative to said front wall such that axial rotation of said elongated member correspondingly varies said orientation of rotation of the front wheel relative to said bottom wall;

said elongated pull handle being pivotally movable between a first storage position in which said pull handle extends along at least a portion of said elongated member and substantially along at least a portion of said front wall, and a second use position in which said pull handle extends outwardly from said front wall and is graspable by a user for transferring user-applied, selectively-directed pull forces to the article of luggage to move the article of luggage along the support surface and to selectively change the direction of movement of the article of luggage along the support surface by pull handle-imparted axially-rotational movement of the elongated member relative to said front wall and a corresponding variation of said orientation of rotation of the front wheel relative to said bottom wall as the elongated member is rotated to thereby change and redirect the direction of movement of the article of luggage in accordance with the variation in orientation of said front wall rotation.

11. An article of wheeled luggage according to claim 10, further comprising means on at least one of said user-controllable means and said mounting means for defining a limited range of rotation of said elongated member relative to said mounting means and for preventing relative rotation of said elongated member beyond said limited range.

* * * * *